United States Patent [19]

Jenny

[11] 4,416,184

[45] Nov. 22, 1983

[54] AMMUNITION CHANNEL

[75] Inventor: Erich Jenny, Schwerzenbach, Switzerland

[73] Assignee: Werkzeugmaschinenfabrik Oerlikon-Bührle AG, Zurich, Switzerland

[21] Appl. No.: 266,087

[22] Filed: May 21, 1981

[30] Foreign Application Priority Data

Jun. 4, 1980 [CH] Switzerland ..... 4319/80

[51] Int. Cl.[3] ..... F41D 10/04

[52] U.S. Cl. ..... 89/33 BB; 193/25 AC

[58] Field of Search ..... 89/33 BB; 193/25 R, 193/25 AC, 25 E, 25 S

[56] References Cited

U.S. PATENT DOCUMENTS 2,819,780 1/1958 Fallon et al. ..... 193/25 AC
3,563,357 2/1971 West ..... 193/25 AC

FOREIGN PATENT DOCUMENTS 566171 12/1944 United Kingdom ..... 89/33 BB
583410 6/1946 United Kingdom .
590783 7/1947 United Kingdom .

*Primary Examiner*—Stephen C. Bentley
*Attorney, Agent, or Firm*—Werner W. Kleeman

[57] ABSTRACT

An ammunition channel or chute is disclosed which is constituted by a multiplicity of juxtapositioned or adjacently arranged lamellae or plate-like elements which are interconnected by elastic elements. These plate-like elements are pivotally arranged between two end parts upon a shaft which is coaxially arranged with respect to the elevation axis of the weapon. The pivoting of one of the end parts, corresponding to the weapon elevation, is uniformly transmitted by means of the resiliently arranged elastic elements to the individual plate-like elements, so that there is ensured for a precise infeed of ammunition throughout each elevation angle of the weapon.

3 Claims, 6 Drawing Figures

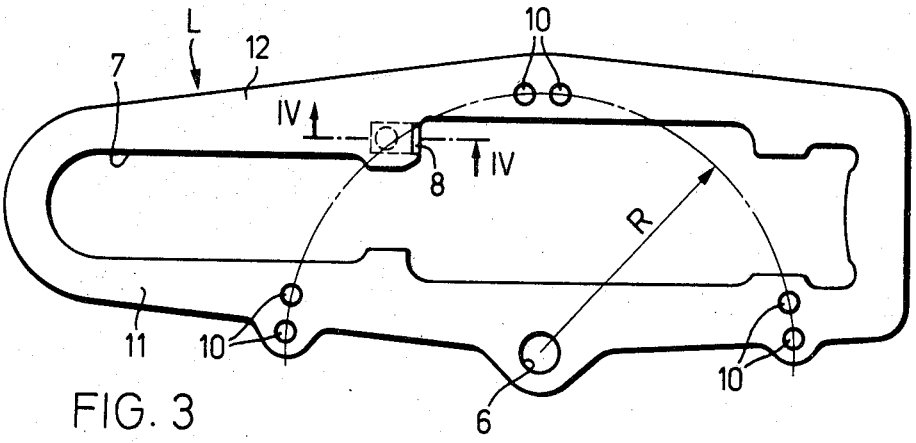
FIG. 3
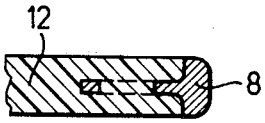
FIG. 4
FIG. 5
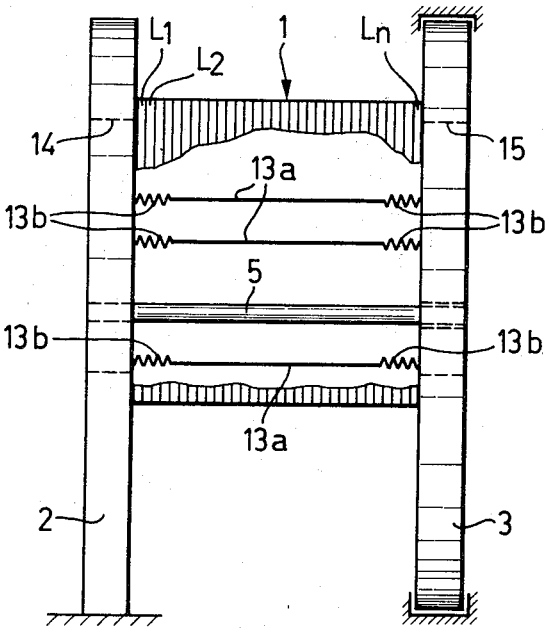
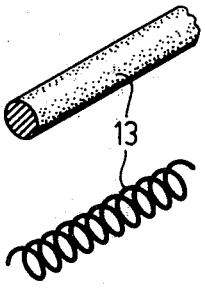
FIG. 6

AMMUNITION CHANNEL

BACKGROUND OF THE INVENTION

The present invention relates to a new and improved construction of an ammunition channel or chute for the infeed of ammunition to a weapon which is pivotable about an elevation axis.

Generally speaking, the ammunition channel or chute of the present development is of the type containing two end parts or portions, one of which is pivotable conjointly with the weapon. There is further provided a multiplicity of lamallae or plate-like elements pivotably arranged between both of these end parts. Through these plate-like elements there are guided tension and torsion resilient elements.

With a heretofore known construction of ammunition channel or chute of this type, as disclosed in British Patent No. 583,410, the adjacently arranged plate-like elements or lamellae possess projections or tongues and recesses or grooves which interengage with one another, by means of which the plate-like elements are mounted upon one another in a bayonet-locking fashion. Additionally, the plate-like elements are interconnected with one another by means of two continuous flexible resiliently arranged elements constructed for instance as springs. One of the major shortcomings of this prior art arrangement is the complicated construction of the individual plate-like elements.

Other prior art constructions of ammunition channels or chutes have been disclosed in U.S. Pat. No. 2,819,780 and British Patent No. 590,783.

SUMMARY OF THE INVENTION

Therefore, with the foregoing in mind it is a primary object of the present invention to provide a new and improved construction of an ammunition channel or chute which is not associated with the aforementioned drawbacks and limitations of the prior art construction discussed in detail above.

Another and more specific object of the present invention aims at providing a new and improved construction of ammunition channel or chute which is designed such that it can be constructed with simple and easy to fabricate relatively thin plate-like elements or lamellae or the like.

A further significant object of the present invention is directed to devising a novel construction of ammunition channel or chute which is relatively simple in construction and design, economical to manufacture, extremely reliable in operation and requires a minimum of maintenance and servicing.

Now in order to implement these and still further objects of the invention, which will become more readily apparent as the description proceeds, the ammunition channel or chute of the present development is manifested by the features that the relatively thin plate-like elements or lamellae are pivotably secured at a shaft which is substantially coaxially arranged with respect to the weapon elevation axis, and this shaft is pivotably secured at both end parts or portions. The resilient or elastic elements which are guided through the plate-like elements are arranged at essentially the same radial spacing from the shaft.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 illustrates in detail one of the relatively thin plate-like elements or lamellae of the ammunition channel or chute;

FIG. 4 is a partial sectional view of the arrangement of FIG. 3, taken substantially along the line IV—IV thereof;

FIG. 5 illustrates a further exemplary embodiment of ammunition channel or chute in a simplified showing; and FIG. 6 illustrates two examples of resilient or elastic elements for interconnecting individual lamellae or plate-like elements of the ammunition channel or chute.

DETAILED DESCRIPTION OF THE PREFERRED EMBODIMENTS

Figure 2:
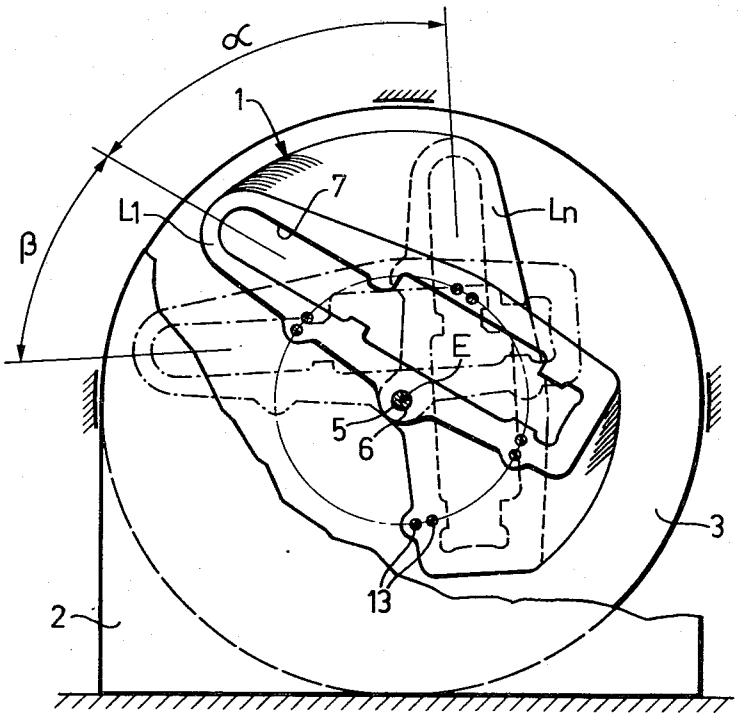
FIG. 2 illustrates the ammunition channel or chute of FIG. 1 in front view and partially in sectional view.
Figure 1:
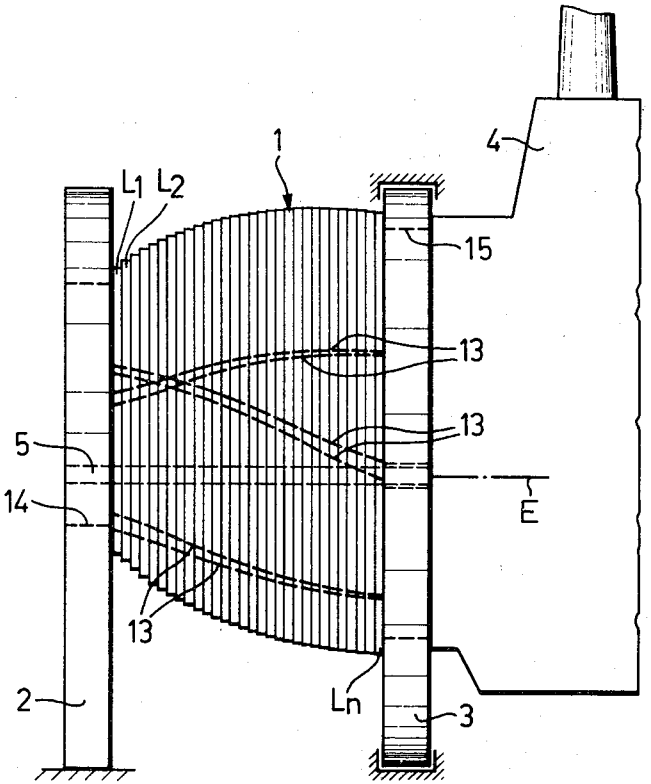
FIG. 1 illustrates a first exemplary embodiment of an ammunition channel or chute in side view and in a position corresponding to maximum weapon elevation.

Describing now the drawings, in FIGS. 1 and 2 there has been illustrated an ammunition channel or chute 1, the end parts or portions 2 and 3 of which are formed, on the one hand, by a wall 2 and, on the other hand, by a rotatably mounted disc or plate 3. The wall 2 is connected in any suitable manner with, for instance, a cartridge magazine or with a further channel or chute section leading to the cartridge magazine. The disc 3 is connected with a firing weapon 4 and is pivotable therewith about an elevation axis E.

Arranged coaxially with respect to the elevation axis E of the weapon 4 is a shaft 5 which is attached to the wall 2 and mounted at the disc or plate member 3. The ammunition channel 1 is formed by a multiplicity of relatively thin plate-like or plate-shaped elements or lamellae $L_1$ to $L_n$ which are pivotably mounted at their apertures or openings 6 upon the shaft 5. These plate-like elements $L_1$ to $L_n$, the shape of which will be apparent by referring to FIG. 3, are provided in each case with a throughpass opening or passage 7 for the ammunition. There are formed in the plate-like elements, generally designated by reference character L, three pairs of openings 10 at a common radius R extending about the axis of the related opening 6. As to these three pairs of openings 10 a respective pair is arranged to each side of the opening 6 at the lower region 11 of the corresponding plate-like element L, whereas the third pair of openings 10 is located at the upper region 12 of such plate-like element, as particularly well seen from FIG. 3.

Elastic or resilient elements 13 are guided through the mutually corresponding openings 10 of all of the plate-like elements or lamellae $L_1$ to $L_n$ which may be constituted by thin discs. These elastic elements 13 are attached in any suitable manner at the end parts or portions 2 and 3, i.e. at the wall or wall member 2 and at the pivotable disc 3.

The throughpass opening or passage 7 of the plate-like element L, as best seen by referring to FIG. 3, is enlarged or widened at its intermediate region and provided with an axial guide surface 8 or the like for cartridge belts. The guide surface 8 ensures that the tip of the cartriges never touches the plate-like elements L. The guide surface 8, as shown in FIG. 4, is formed by a piece of material which possesses a greater hardness than that of the cartridge belt itself. Advantageously, there is cast a piece of hardened steel into the material of the plate-like elements L, which for instance can be fabricated of any suitable plastics material.

The wall 2 is provided with an inlet opening 14, as shown in FIG. 1, wherein the lengthwise axis thereof advantageously is inclined with respect to the horizontal plane at an inlet angle corresponding approximately to the mean or average weapon elevation angle. From the showing of FIG. 2 there will be apparent the position of the first plate-like element $L_1$, whose passage or throughpass opening 7 is practically continuously inclined at the same starting angle as the inlet opening 14 which has not been particularly shown in such FIG. 2. The attachment locations for the elements 13 at the wall or wall member 2 correspond to the arrangement of the openings 10 for a plate-like element L which is inclined at the same starting or initial angle.

The disc or disc member 3 is provided with an outlet opening 15, as will be seen from the showing of FIG. 1, wherein the shape thereof corresponds to the throughpass opening 7 of the relatively thin plate-like elements L. Also the attachment points for the elastic or resilient elements 13 at the disc 3 are distributed in relation to the outlet opening 15 in accordance with the distribution of the openings 10 in relation to the throughpass opening 7 of a plate-like element L, and such distributively arranged attachment points are all located at the same spacing from the weapon elevation axis E.

The disc 3 is pivotable in both directions of rotation conjointly with the weapon 4 which is pivotable about the elevation axis E. By means of the elastic elements 13 or equivalent structure the pivotal movement of the disc 3 is transmitted to the plate-like elements $L_n$, $L_{n-1}$ . . . $L_1$, and the throughpass opening 7 of the last plate-like element $L_n$ is always practically inclined at the same angle as the outlet opening 15 of the disc 3. To ensure that the pivoting movement, corresponding to the momentary elevation of the weapon 4, is uniformly transmitted to all of the plate-like elments $L_{n-1}$, $L_{n-2}$ and so forth, the elements 13 are preferably constructed over their entire region so as to be elastic or tension and torsion resilient; for instance, there can be used as the elements 13 elastomeric or rubber bands, belts or hoses, prestressed tension and torsion springs and so forth, as shown in FIG. 6. However, it is within the teachings of the invention to also elastically pre-bias between the end portions or parts 2 and 3 of the ammunition channel or chute 1 heretofore known flexible means, as the same has been schematically illustrated in FIG. 5. Reference character **13*a* designates the flexible attachment portion of the elements 13, whereas reference character 13*b* designates the elastic attachment portion of the elements 13**.

In FIG. 2 there has been illustrated in broken lines an extreme pivoting or rocking of the last plate-like element $L_n$, corresponding to the maximum weapon elevation, about an angle $\alpha$ in relation to the first plate-like element $L_1$; there has been shown in phantom or chain-dot lines an extreme pivoting of the last plate-like element $L_n$ corresponding to the minimum weapon elevation, about an angle $\beta$ in the other rotational direction or sense.

During pivoting or rocking of the disc 3 the elastic elements 13, which are guided through the openings 10 of the individual plate-like elements L, are tensioned or stressed in their length and wound in a helical-shaped configuration upon an imaginary cylinder jacket or shell having the radius R, as will be seen by referring to FIG. 1. Consequently, there is uniformly transmitted such pivotal movement to all of the plate-like or plate-shaped elements $L_1$ to $L_n$.

In the illustrated exemplary embodiment there are employed thirty plate-like elements L. With an elevation range of $-5°$ to $+85°$ there is chosen a starting or initial angle of 30°.

The selection of the starting angle, according to the invention, affords appreciable advantages. Thus, there is realised infeed of the cartridges within a most compact space or region, i.e. with the minimum required channel or chute length. The necessary spacing of both end parts or portions 2 and 3 of the ammunition channel 1, namely the wall 2 and the disc or plate 3, depends upon the degree of torsion or twisting which the cartridge belt can undergo. It is for instance completely possible to accommodate the starting or initial angle to an extreme elevation angle, for instance $-5°$, and to pivot the plate-like elements $L_1$ to $L_n$ only in one rotational sense. The thus required spacing of both end parts or portions 2 and 3, which is dependent upon the amount of torsion or twist which the cartridge belt is capable of being subjected to, can be reduced by one-half by virtue of the inventive selection of the starting or initial angle, since the torsion or twisting of the cartridge belt in both directional senses can be optimumly utilized. Since the twistability in both directional senses always is somewhat different, the starting or initial angle also deviates somewhat from the mean or average elvation angle (30° instead of 40°).

With the exemplary embodiment illustrated in FIGS. 1 and 2 there have been provided three pairs of elastic or resilient elements 13. However, there could be only selected three individual or, in fact, a different number of elements 13, depending upon the elasticity of the employed elements 13, and consideration should be given to uniform force transmission and to favorable loading of the plate-like elements L. Since all of the elements 13 are arranged at the same radial spacing from the shaft 5 there is insured for a uniform loading of the individual elements 13.

While there are shown and described present preferred embodiments of the invention, it is to be distinctly understood that the invention is not limited thereto, but may be otherwise variously embodied and practiced within the scope of the following claims. Accordingly,

I claim:

1. An ammunition channel for the infeed of ammunition to a weapon which is pivotable about an elevation axis, comprising:

two end portions;

one of said end portions being mounted to be pivotable conjointly with the weapon;

a plurality of substantially planar plate-shaped elements pivotably arranged between both of said end portions;

tension and torsion resilient elements guided through said plate-shaped elements and attached to said end portions;

a shaft arranged substantially coaxially with respect to the elevation axis of the weapon;

said shaft being rotatably mounted in both of said end portions;

said plate-shaped elements being pivotably mounted upon said shaft; and said tension and torsion resilient elements being arranged at essentially the same radial spacing from the shaft and directly extending through said plate-shaped elements.

2. An ammunition channel for the infeed of ammunition to a weapon which is pivotable about an elevation axis, comprising:

two end portions;

one of said end portions being mounted to be pivotable conjointly with the weapon;

a plurality of substantially planar plate-shaped elements pivotably arranged between both of said end portions;

tension and torsion resilient elements guided through said plate-shaped elements and attached to said end portions;

a shaft arranged substantially coaxially with respect to the elevation axis of the weapon;

said shaft being rotatably mounted in both of said end portions;

said plate-shaped elements being pivotably mounted upon said shaft;

said tension and torsion resilient elements being arranged at essentially the same radial spacing from the shaft; and said tension and torsion resilient elements exclusively governing the rotation between the individual plate-shaped elements.

3. An ammunition channel for the infeed of ammunition to a weapon which is pivotable about an elevation axis, comprising:

two end portions;

one of said end portions being mounted to be pivotable conjointly with the weapon;

a plurality of substantially plate-like elements pivotably arranged between both of said end portions;

tension and torsion resilient elements guided through said plate-like elements and operatively associated with said end portions;

a shaft mounted substantially coaxially with respect to the elevation axis of the weapon;

said coaxial shaft being pivotably secured to both of said end portions;

said plate-like elements being pivotably mounted upon said shaft;

said tension and torsion resilient elements being arranged at essentially the same radial spacing from the shaft;

at least three of said tension and torsion elements being provided;

said tension and torsion resilient elements comprising elastomeric bands;

each of said plate-like elements comprising a disk member possessing a throughpass opening configured to handle the infed ammunition;

each of said plate-like elements having an opening for receiving the shaft;

each of said plate-like elements being provided with at least three openings for receiving said tension and torsion resilient elements;

two of said three openings for receiving said tension and torsion resilient elements being arranged to one side of said throughpass opening and to both sides of said opening receiving said shaft; and the third opening for receiving said tension and torsion resilient elements being located at another side of said throughpass opening.

* * * * *